US010311789B2

(12) United States Patent
Sano et al.

(10) Patent No.: US 10,311,789 B2
(45) Date of Patent: Jun. 4, 2019

(54) PIXEL CIRCUITS AND PIXEL ARRAY

(71) Applicant: AOT Limited, Shenzhen, Guangdong (CN)

(72) Inventors: Keiichi Sano, Hong Kong (HK); Ryuji Nishikawa, Hong Kong (HK)

(73) Assignee: AOT LIMITED, Shenzhen, Guangdong (CN)

( * ) Notice: Subject to any disclaimer, the term of this patent is extended or adjusted under 35 U.S.C. 154(b) by 0 days.

(21) Appl. No.: 15/873,600

(22) Filed: Jan. 17, 2018

(65) Prior Publication Data

US 2018/0211594 A1 Jul. 26, 2018

Related U.S. Application Data

(63) Continuation-in-part of application No. 15/697,861, filed on Sep. 7, 2017.

(30) Foreign Application Priority Data

Jan. 26, 2017 (CN) ..... 2017 1 0061570

(51) Int. Cl.
*G09G 3/3233* (2016.01)

(52) U.S. Cl.
CPC ... *G09G 3/3233* (2013.01); *G09G 2300/0819* (2013.01); *G09G 2300/0861* (2013.01); *G09G 2310/0262* (2013.01); *G09G 2320/0233* (2013.01); *G09G 2320/043* (2013.01)

(58) Field of Classification Search
CPC ..... G09G 3/3233
See application file for complete search history.

(56) References Cited

U.S. PATENT DOCUMENTS

2006/0187153 A1* 8/2006 Nathan ..... G09G 3/3233 345/76

* cited by examiner

*Primary Examiner* — William A Harriston
(74) *Attorney, Agent, or Firm* — Birch, Stewart, Kolasch & Birch, LLP

(57) ABSTRACT

A pixel circuit includes a selection transistor, a driving transistor, an emissive element, a first capacitor, and a reference transistor. The selection transistor is coupled to a gate line and a data line. A control electrode of the driving transistor is coupled to the selection transistor and a first electrode of the driving transistor is coupled to a power source line. The emissive element emits light according to a current drawn from the driving transistor. The first capacitor is coupled to the driving transistor and an emission signal line. A control electrode of the reference transistor is coupled to a reference signal line providing a selectable voltage with a first predetermined level and a second predetermined level. A first electrode of the reference transistor is coupled to the control electrode of the driving transistor.

21 Claims, 11 Drawing Sheets

PIXEL CIRCUITS AND PIXEL ARRAY

CROSS REFERENCE TO RELATED APPLICATIONS

This application is a Continuation-In-Part of pending U.S. patent application Ser. No. 15/697,861, filed 2017 Sep. 7 and entitled "Pixel circuits", and further claims priority of China Patent Application No. 201710061570.5, filed on 2017 Jan. 26, the entirety of which is incorporated by reference herein.

BACKGROUND OF THE INVENTION

Field of the Invention

The invention relates to a pixel circuit in a display device, and more particularly to a pixel circuit that can compensate for threshold voltage variations to reduce current non-uniformities.

Description of the Related Art

With the rapid developments being made in display technologies, display devices with touch functionality are becoming more and more popular because of visualization and other advantages. Based on the position of the touch panel relative to the display panel, existing display devices can generally be divided into two groups, i.e. on-cell touch panels and in-cell touch panels. Compared to an on-cell touch panel, an in-cell touch panel is thinner and has a higher light transmittance, and therefore it has a wider range of applications. As for display devices currently in use, the light-emitting device known as an organic light-emitting diode (OLED) is increasingly being used in the field of high-performance displays, as it has characteristics such as self-illumination, fast response, wide viewing angle, and it can be produced on a flexible substrate. OLED display devices can be divided into PMOLED (Passive Matrix driving OLED) and AMOLED (Active Matrix driving OLED) according to the driving mode. AMOLED display devices are expected to replace the LCD (Liquid-Crystal Display) in the next generation of flat-panel displays, thanks to their low manufacturing cost, high response speed, low power consumption, being DC driving for portable devices, wide operating temperature range, and other advantages. Therefore, AMOLED display panels are becoming more and more popular.

In current AMOLED display panels, each OLED is driven to emit light by a driving circuit formed by a plurality of TFTs (Thin Film Transistors) within the same pixel unit as the OLED located on the array substrate, thereby implementing the display. However, variations in the threshold voltage among the driving TFTs result in a non-uniform image on the display. It is difficult to obtain uniform properties of the TFTs on the whole display area.

Therefore, it is desirable to provide a novel pixel circuit to suppress the effects of variations of the threshold voltage among the driving TFTs without adding too many elements to the pixel circuit.

BRIEF SUMMARY OF THE INVENTION

Pixel circuits are provided. An exemplary embodiment of a pixel circuit comprises a selection transistor, a driving transistor, an emissive element, a first capacitor, and a reference transistor. The selection transistor comprises a control electrode, a first electrode, and a second electrode.

The control electrode of the selection transistor is coupled to a gate line for receiving a selection signal and the first electrode of the selection transistor is coupled to a data line. The driving transistor comprises a control electrode, a first electrode, and a second electrode. The control electrode of the driving transistor is coupled to the second electrode of the selection transistor and the first electrode of the driving transistor is coupled to a power source line. The emissive element is coupled to the second electrode of the driving transistor and emits light according to a current drawn from the driving transistor. The first capacitor comprises a first terminal coupled to the control electrode of the driving transistor and a second terminal coupled to an emission signal line. The reference transistor comprises a first electrode, a second electrode, and a control electrode coupled to a reference signal line providing a selectable voltage with a first predetermined level and a second predetermined level. The first electrode of the reference transistor is coupled to the control electrode of the driving transistor.

Another exemplary embodiment of a pixel circuit comprises a plurality of pixel circuits each having the same structure. Each pixel circuit comprises a selection transistor, a driving transistor, an emissive element, a first capacitor, and a reference transistor. The selection transistor comprises a control electrode, a first electrode, and a second electrode. The control electrode of the selection transistor is coupled to a gate line for receiving a selection signal and the first electrode of the selection transistor is coupled to a data line. The driving transistor comprises a control electrode, a first electrode, and a second electrode. The control electrode of the driving transistor is coupled to the second electrode of the selection transistor and the first electrode of the driving transistor is coupled to a power source line. The emissive element is coupled to the second electrode of the driving transistor and emits light according to a current drawn from the driving transistor. The first capacitor comprises a first terminal coupled to the control electrode of the driving transistor and a second terminal coupled to an emission signal line. The reference transistor comprises a control electrode coupled to a reference signal line providing a selectable voltage with a first predetermined level and a second predetermined level, a first electrode, and a second electrode. The first electrode of the reference transistor is coupled to the control electrode of the driving transistor. The second electrode of the reference transistor of a first pixel circuit is coupled to the first capacitor of a second pixel circuit.

Another exemplary embodiment of a pixel circuit comprises a pair of pixel units and a selection transistor. The pair of pixel units comprises a first pixel unit and a second pixel unit. The first pixel unit comprises a first driving transistor, a first emissive element, a first reference transistor and a first capacitor. The first driving transistor comprises a control electrode, a first electrode coupled to a power source line, and a second electrode. The first emissive element is coupled to the second electrode of the first driving transistor and emits light according to a current drawn from the first driving transistor. The first reference transistor comprises a control electrode coupled to a first reference signal line, a first electrode coupled to the control electrode of the first driving transistor, and a second electrode. The first capacitor comprises a first terminal coupled to the control electrode of the first driving transistor and a second terminal coupled to a first emission signal line. The second pixel unit comprises a second driving transistor, a second emissive element, a second reference transistor and a second capacitor. The second driving transistor comprises a control electrode, a first electrode coupled to the power source line, and a second electrode. The second emissive element is coupled to the second electrode of the second driving transistor and emits light according to a current drawn from the second driving transistor. The second reference transistor comprises a control electrode coupled to a second reference signal line, a first electrode coupled to the control electrode of the second driving transistor, and a second electrode. The second capacitor comprises a first terminal coupled to the control electrode of the second driving transistor and a second terminal coupled to a second emission signal line. The selection transistor comprises a control electrode coupled to a gate line for receiving a selection signal, a first electrode coupled to a data line, and a second electrode coupled to the control electrode of the first driving transistor and the control electrode of the second driving transistor. The second electrode of the first reference transistor is coupled to the first terminal of the second capacitor.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
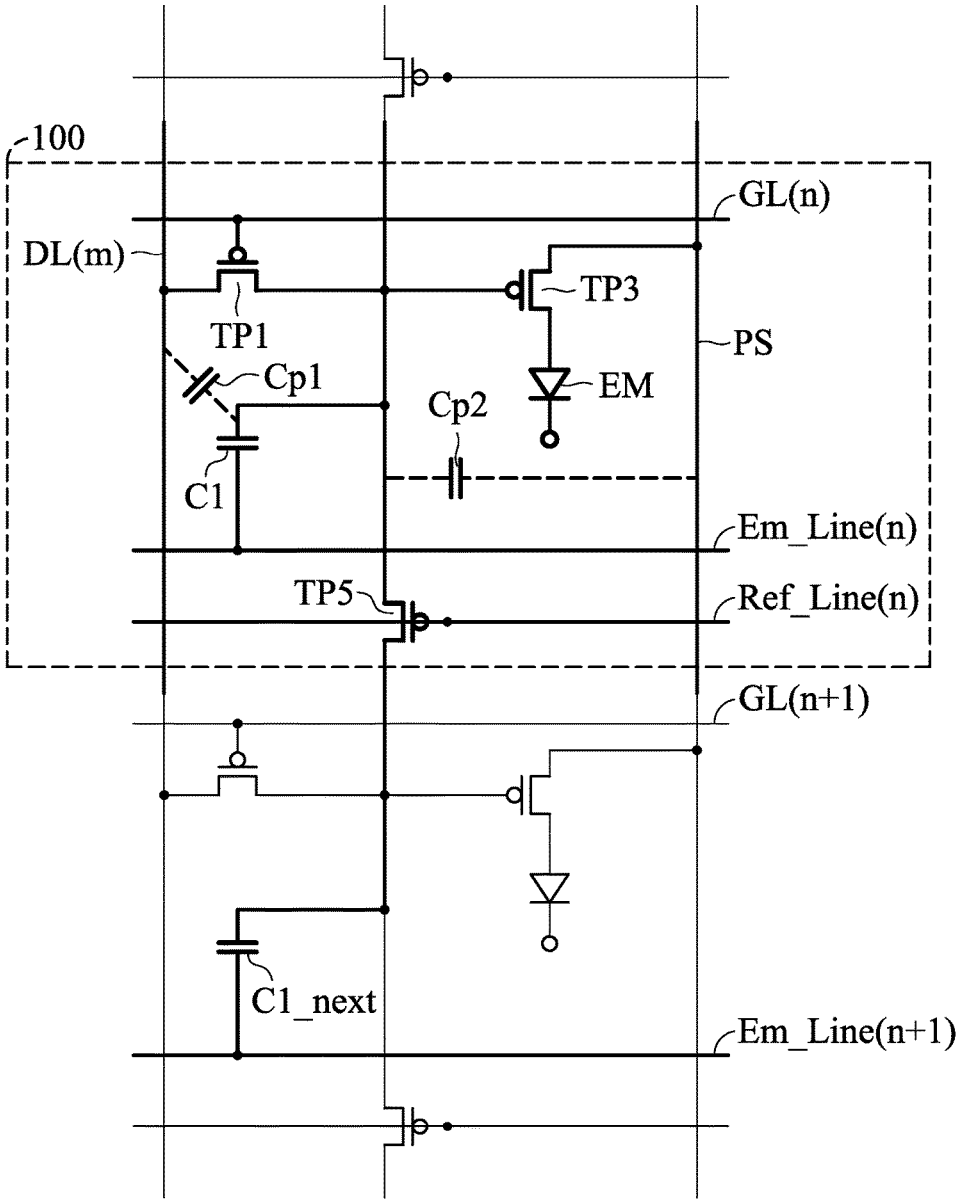
FIG. 1 is an exemplary circuit diagram of a pixel circuit according to a first embodiment of the invention.

FIG. 1 is an exemplary circuit diagram of a pixel circuit according to a first embodiment of the invention. The pixel circuit 100 may comprise a selection transistor TP1, a driving transistor TP3, a reference transistor TP5, an emissive element EM, and a capacitor C1. In the first embodiment of the invention, the selection transistor TP1, the driving transistor TP3 and the reference transistor TP5 are P-type transistors.

The selection transistor TP1 may comprise a control electrode coupled to a gate line GL(n) for receiving a selection signal therefrom, a first electrode coupled to a data line DL(m) and a second electrode. The driving transistor TP3 may comprise a control electrode coupled to the second electrode of the selection transistor TP1, a first electrode coupled to a power source line PS and a second electrode. The emissive element EM, such as an OLED, may be coupled to the second electrode of the driving transistor TP3 and emit light according to a current drawn from the driving transistor TP3. The capacitor C1 may comprise a first terminal coupled to the control electrode of the driving transistor TP3 and a second terminal coupled to an emission signal line Em_Line(n). The reference transistor TP5 may comprise a control electrode, a first electrode, and a second electrode. The control electrode of the reference transistor TP5 is coupled to a reference signal line Ref_Line(n). The first electrode of the reference transistor TP5 is coupled to the control electrode of the driving transistor TP3, and the second electrode of the reference transistor TP5 is coupled to the capacitor C1_next of the next pixel circuit. Note that the next pixel circuit comprises the same components and has the same structure as the pixel circuit 100. According to an embodiment of the invention, the reference signal line Ref_Line(n) may provide a selectable voltage with a first predetermined level and a second predetermined level.

There may be N*M such pixel circuits, as per the pixel circuit 100 shown in FIG. 1, arranged in a matrix in a display device to form a pixel array, where n, m, N and M are positive integers and $0 \le n \le N$, $0 \le m \le M$. Note that in an embodiment of the invention, one row (for example, the bottom row) of the pixel circuits in the pixel array may be designed as dummy pixel circuits.

Figure 2:
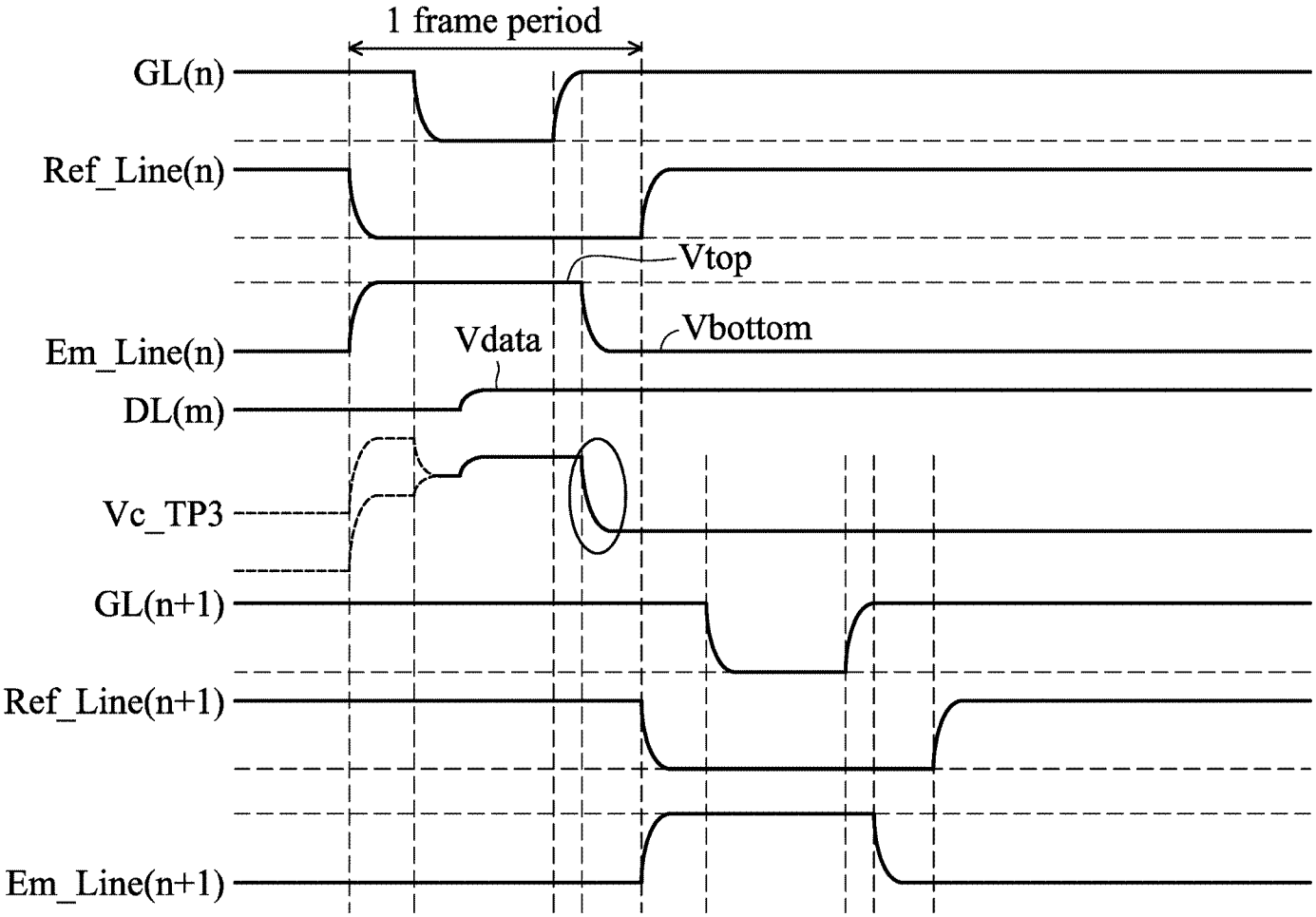
FIG. 2 is an exemplary diagram showing the signal waveforms according to an embodiment of the invention.

FIG. 2 is an exemplary diagram showing the signal waveforms according to an embodiment of the invention. As shown in FIG. 2, prior to the arrival of a selection signal pulse on the gate line GL(n), the voltage at the reference signal line Ref_Line(n) may be set from the second predetermined level (for example, +6V) to the first predetermined level (for example, 0V), which is lower than the second predetermined level. According to an embodiment of the invention, prior to the arrival of a selection signal pulse, the reference transistor TP5 is turned off when the voltage at the reference signal line Ref_Line(n) is set to the second predetermined level and turned on when the voltage at the reference signal line Ref_Line(n) is set to the first predetermined level.

In addition, prior to the arrival of a selection signal pulse on the gate line GL(n), a rising pulse or a voltage may be generated on the emission signal line Em_Line(n) to set the voltage on the emission signal line Em_Line(n) to the top voltage Vtop. According to an embodiment of the invention, the top voltage Vtop may be set at approximately +6V, and the power source line PS may be designed to provide a voltage of 0V or approaching 0V. At this time, the reference transistor TP5 is turned on and the driving transistor TP3 is turned off.

When a selection signal pulse on the gate line GL(n) arrives (e.g. a falling edge of the pulse on the gate line GL(n) as shown), the selection transistor TP1 is turned on, and data voltage Vdata on the data line DL(m) is transmitted to the control electrode of the driving transistor TP3 and the first electrode of the reference transistor TP5. According to an embodiment of the invention, since the reference transistor TP5 is turned on as the voltage at the reference signal line Ref_Line(n) is set to the first predetermined level, when the selection transistor TP1 is turned on, the data voltage Vdata is applied to the capacitor C1 coupled to the first electrode of the reference transistor TP5, and also applied to the capacitor C1_next in the next pixel circuit coupled to the second electrode of the reference transistor TP5. In this manner, the data voltage Vdata can be stored in the capacitors C1 and C1_next when the reference transistor TP5 is turned on.

When the selection signal pulse on the gate line GL(n) ends (e.g. after a rising edge of the pulse on the gate line GL(n) as shown), the selection transistor TP1 is turned off, and the capacitors C1 and C1_next can hold the data voltage Vdata. According to an embodiment of the invention, the data voltage Vdata may correspond to the video signal for display at a corresponding pixel, and represent, for example, a range from a white level to a black level in the voltage range of approximately 3V to 4V. After the selection signal pulse ends, the reference transistor TP5 is turned on and the driving transistor TP3 is turned off (the voltage of power source line PS is set to 0V).

After the selection transistor TP1 is turned off, the voltage on the emission signal line Em_Line(n) may be reduced to, for example, −3V, to induce a voltage change or a voltage transition (that is, a voltage drop from a high level to a low level in this example) on the emission signal line Em_Line (n). In response to the voltage change or voltage transition on the emission signal line Em_Line(n), the voltage Vc_TP3 at the control electrode of the driving transistor TP3 is changed as well with the Vth compensation effect (as shown by the portion marked with a circle in FIG. 2). For example, the voltage Vc_TP3 is lowered by approximately 7V, and then the driving transistor TP3 is turned on to provide the current to the emissive element EM.

After the voltage transition on the emission signal line Em_Line(n), the voltage at the reference signal line Ref_Line(n) may be reset to the second predetermined level (for example +6V). Note that, in the embodiments of the invention, the voltage at the reference signal line Ref_Line (n) may be set to the first predetermined level within one frame period, and then reset to the second predetermined level after the selection signal pulse and the emission signal pulse are applied. After that, the reference transistor TP5 is turned off.

This operation is performed sequentially and repeatedly in the matrix, and then an image can be displayed (Note that the dotted lines in the beginning of the voltage Vc_TP3 represent the signal waveforms in a previous frame, which may be a high-state or a low-state signal).

Since the voltage on the emission signal line Em_Line(n) is decreased from approximately +6V to −3V, the voltage at the first electrode of the reference transistor TP5 decreases from approximately 3V~4V to approximately 0 V~(−3V), and the reference transistor TP5 changes from an ON-state to an OFF-state (that is, it changes from being turned on to being turned off).

Figure 3:
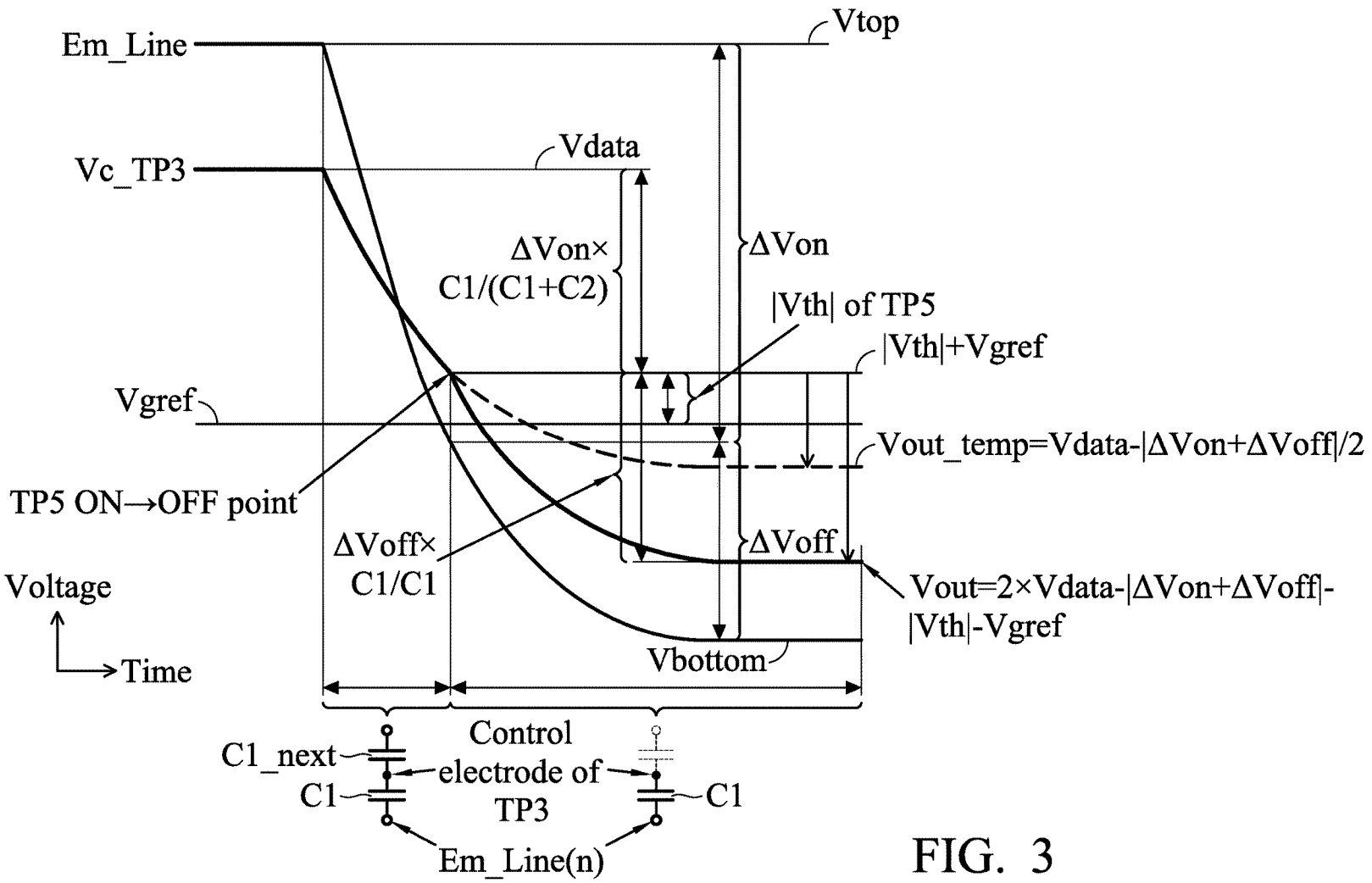
FIG. 3 shows an enlarged chart of the portion marked with a circle in FIG. 2.

FIG. 3 shows an enlarged chart of the portion marked with a circle in FIG. 2. When the voltage on the emission signal line Em_Line(n) begins to drop, the voltage Vc_TP3 at the control electrode of the driving transistor TP3 drops as well. When the voltage Vc_TP3 at the control electrode of the driving transistor TP3 drops to a predetermined switch-point voltage (shown as the TP5 ON→OFF point in FIG. 3), the reference transistor TP5 is turned off (since the Vgs voltage becomes insufficient to turn on the reference transistor TP5). Therefore, in the embodiment of the invention, the reference transistor TP5 is switched from being turned on to being turned off during the voltage change or voltage transition.

Viewing from the control electrode of the driving transistor TP3, the connected capacitance value is changed from [(C1+α)+(C2+α)] to (C1+α) as the reference transistor TP5 is switched from ON to OFF, where C1 represents the capacitance of the capacitor C1, C2 represents the capacitance of the capacitor C1_next in the next pixel circuit coupled to the second electrode of the reference transistor TP5, and a represents the equivalent capacitance contributed by the overall parasitic capacitors (such as parasitic capacitors Cp1 and Cp2 shown in FIG. 1) in one pixel circuit. The timing of this capacitance change is related to the Vth value of the reference transistor TP5.

Suppose that, in an embodiment of the invention, capacitor C1 and capacitor C1_next have equal capacitance. After the voltage Vc_TP3 at the control electrode of the driving transistor TP3 has passed |Vth| level (where |Vth| is the threshold voltage of the reference transistor TP5), the descending ratio in the ΔVoff term becomes 2 times the level of the ΔVon term because there is no distribution of capacitance (C2+a), where ΔVon represents the voltage difference, between the top voltage Vtop and the switch-point voltage where the reference transistor TP5 is switched from ON to OFF, of the signal on the emission signal line Em_Line(n) and ΔVoff represents the voltage difference, between the switch-point voltage and the bottom voltage Vbottom, of the signal on the emission signal line Em_Line(n).

The resulting voltage Vout at the control electrode of the driving transistor TP3 is derived as indicated below.

In FIG. 3, the dotted line is a temporary waveform of the voltage at the control electrode of the driving transistor TP3 if the reference transistor TP5 is maintained in an ON state (that is, not switched to an OFF state).

In this case, the resulting voltage Vout_temp at the control electrode of the driving transistor TP3 (when the reference transistor TP5 is kept on) drops by an amount of |ΔVon+ΔVoff|*[(C1+α)/(C1+C2+2α)] from the Vdata level. Note that when C1=C2, [(C1+α)/(C1+C2+2α)]=½ can be obtained. Therefore, $$V\text{out_temp}=V\text{data}-|\Delta V\text{on}+\Delta V\text{off}|/2 \quad \text{Eq.(1)}$$

can be obtained.

Note that when the reference transistor TP5 is kept on, the |Vth| term is not included in the resulting voltage Vout_temp. In this manner, the overall operation cannot compensate for the threshold voltage variation.

On the other hand, according to the embodiment of the invention, the reference transistor TP5 is turned off at the switch point as shown in FIG. 3. After crossing a baseline level: |Vth|+Vgref as shown in FIG. 3, the voltage Vc_TP3 at the control electrode of the driving transistor TP3 drops 2 times the value of the temporary voltage (the dotted line in FIG. 3), where |Vth| is the threshold voltage of the reference transistor TP5 and Vgref is the voltage with first predetermined level provided to the control electrode of the reference transistor TP5.

Therefore, the resulting voltage Vout can be obtained as:

$$\begin{aligned} Vout &= (|Vth| + Vgref) - 2*((|Vth| + Vgref) - \text{Vout_temp}) \\ &= (|Vth| + Vgref) - 2*((|Vth| + Vgref) - (Vdata - |\Delta Von + \Delta Voff|/2)) \\ &= 2*Vdata - |\Delta Von + \Delta Voff| - (|Vth| + Vgref) \end{aligned} \quad \text{Eq. (2)}$$

Note that the |Vth| term is included in the resulting voltage Vout, so as to compensate for the threshold voltage variation. In cases where the transistors in one pixel circuit have the same threshold voltage, the threshold voltage variation can be compensated for by including the threshold voltage |Vth| of the reference transistor TP5 in the resulting voltage Vout at the control electrode of the driving transistor TP3.

To be more specific, since the reference transistor TP5 is a P-type transistor, the resulting voltage Vout in Eq.(2) can be further derived as:

$$Vout=2*Vdata+(Vem_on-Vem_off)+(Vth-Vgref) \quad \text{Eq.(2-1)}$$

where Vem_off refers to the emission pulse voltage on Vdata input period (which is the top voltage Vtop as discussed above), and Vem_on refers to the emission pulse voltage on emission period (which is the bottom voltage Vbottom as discussed above).

The current Ids provided by the driving transistor TP3 (Ids(TP3)) is controlled by the Vgs voltage of driving transistor TP3 (Vgs(TP3)).

In general, using the MOS current approximate expression, the current Ids can be derived as:

$$Ids=W/L*Co*\mu*(Vgs-Vth-\tfrac{1}{2}*Vds)*Vds \text{ when } (Vds<Vgs-Vth) \quad \text{Eq.(2-2)}$$

$$Ids=W/L*Co*\mu*\tfrac{1}{2}*(Vgs-Vth)\hat{}2 \text{ when}(Vds\geq Vgs-Vth) \quad \text{Eq.(2-3)}$$

where W refers to the channel width, L refers to the channel length, Co refers to the capacitance per unit gate area, μ refers to the mobility, Vgs refers to the gate-source voltage, and Vds refers to the drain-source voltage.

Since for OLED driving current, the independent region on Vds is used, the equation for (Vds≥Vgs−Vth) is adopted. Therefore, Ids ∝(Vgs−Vth)^2 can be obtained.

Eq. (2-4)

$$\begin{aligned} Vgs(TP3) &= Vg(TP3) - Vs(TP3) \\ &= Vout - Vs(TP3) \\ &= 2*Vdata + (\text{Vem_on} - \text{Vem_off}) + (Vth(TP5) - Vgref) - Vs(TP3) \\ &= 2*Vdata + (\text{Vem_on} - \text{Vem_off}) - Vgref - Vs(TP3) + Vth(TP5) \end{aligned}$$

Therefore, current Ids provided by the driving transistor TP3 (Ids(TP3) can be derived as:

$$Ids(TP3)\propto(2*Vdata+(Vem_on-Vem_off)-Vgref-Vs(TP3)+Vth(TP5)-Vth(TP3))\hat{}2 \quad \text{Eq.(2-5)}$$

When the transistors in one pixel circuit have the same threshold voltage, that is, Vth(TP5)=Vth(TP3), Vth term can be removed from Ids, so as to compensate for the threshold voltage variation.

Therefore, the voltages Vc_TP3 at the control electrode of the driving transistor TP3 will not be affected by the threshold voltage variation, and thus the current generated to drive the emissive element EM can be kept the same regardless of how much the threshold voltage Vth varies.

Figure 4B:
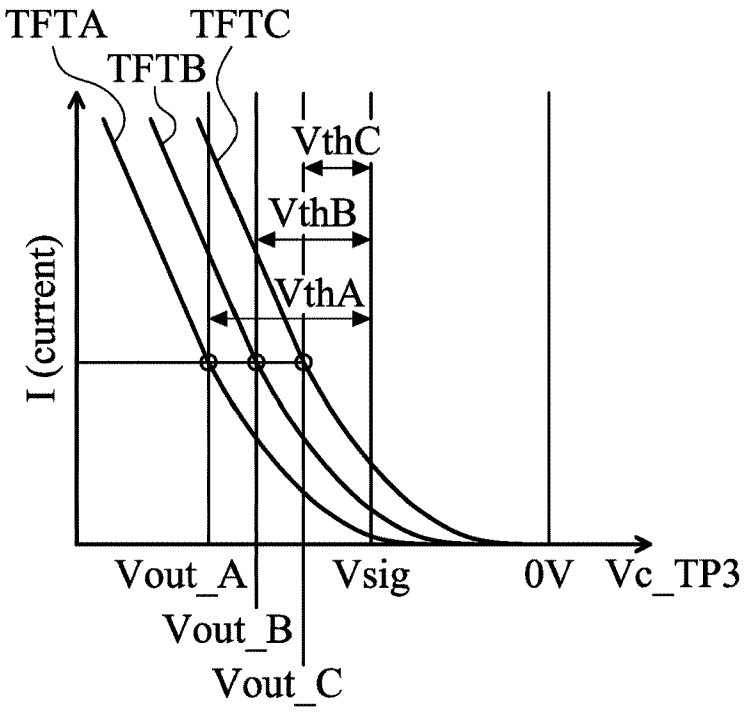
FIG. 4B shows an exemplary current-voltage curve of the driving transistor with threshold voltage compensation according to an embodiment of the invention.
Figure 4A:
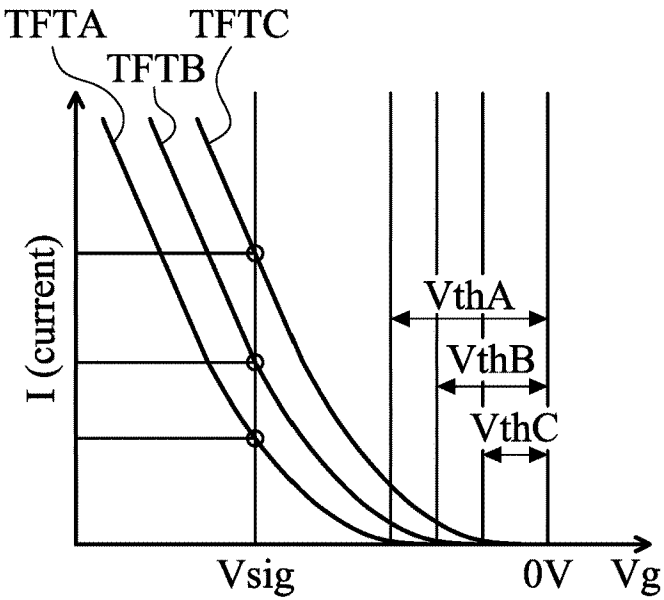
FIG. 4A shows the current-voltage curve of the driving transistor in the conventional design without threshold voltage compensation.

FIG. 4A shows the current-voltage curve of the driving transistor in the conventional design without making a threshold voltage compensation, where the voltage Vg represents the driving voltage provided at the control electrode of the driving transistor in the conventional design and I represents the driving current generated by the driving transistor. Suppose there are three transistors TFTA, TFTB and TFTC with different threshold voltages VthA, VthB and VthC. Defining the voltage Vsig=2*Vdata−|ΔVon+ΔVoff|−Vgref, it can be seen from FIG. 4A that under the same driving voltage Vsig, the three transistors output different driving current to drive the emissive element EM because of different threshold voltages, causing the non-uniform image display problem.

FIG. 4B shows an exemplary current-voltage curve of the driving transistor with threshold voltage compensation according to an embodiment of the invention, where the voltage Vc_TP3 represents the driving voltage provided at the control electrode of the driving transistor TP3 and I represents the driving current generated by the driving transistor TP3. It can be seen from FIG. 4B that the resulting voltage Vout at the control electrode of the driving transistor TP3 is compensating for the threshold voltage variation by including the threshold voltage |Vth| as indicated below:

$$Vout_A=Vsig-|VthA| \quad \text{Eq.(3)}$$

$$Vout_B=Vsig-|VthB| \quad \text{Eq.(4)}$$

$$Vout_C=Vsig-|VthC| \quad \text{Eq.(5).}$$

In this manner, uniform current/luminance on the display can be obtained.

Note that, based on the concept of the invention, even when the threshold voltages are different in different pixel circuits (that is, different pixels in the pixel array), the currents generated to drive the emissive elements in different pixel circuits can be kept the same and the uniformity of the image in the whole display area can be maintained. In this manner, the non-uniform image problem caused by the threshold voltage variation among different pixels in the conventional design can also be solved.

Note further that, in the embodiments of the invention, when manufacturing the pixel array, the capacitance contributed by all the parasitic capacitors (such as parasitic capacitors Cp1 and Cp2 shown in FIG. 1) in each pixel circuit is preferably controlled to be the same, such that the variation in the threshold voltage can be compensated for as discussed above.

Figure 5:
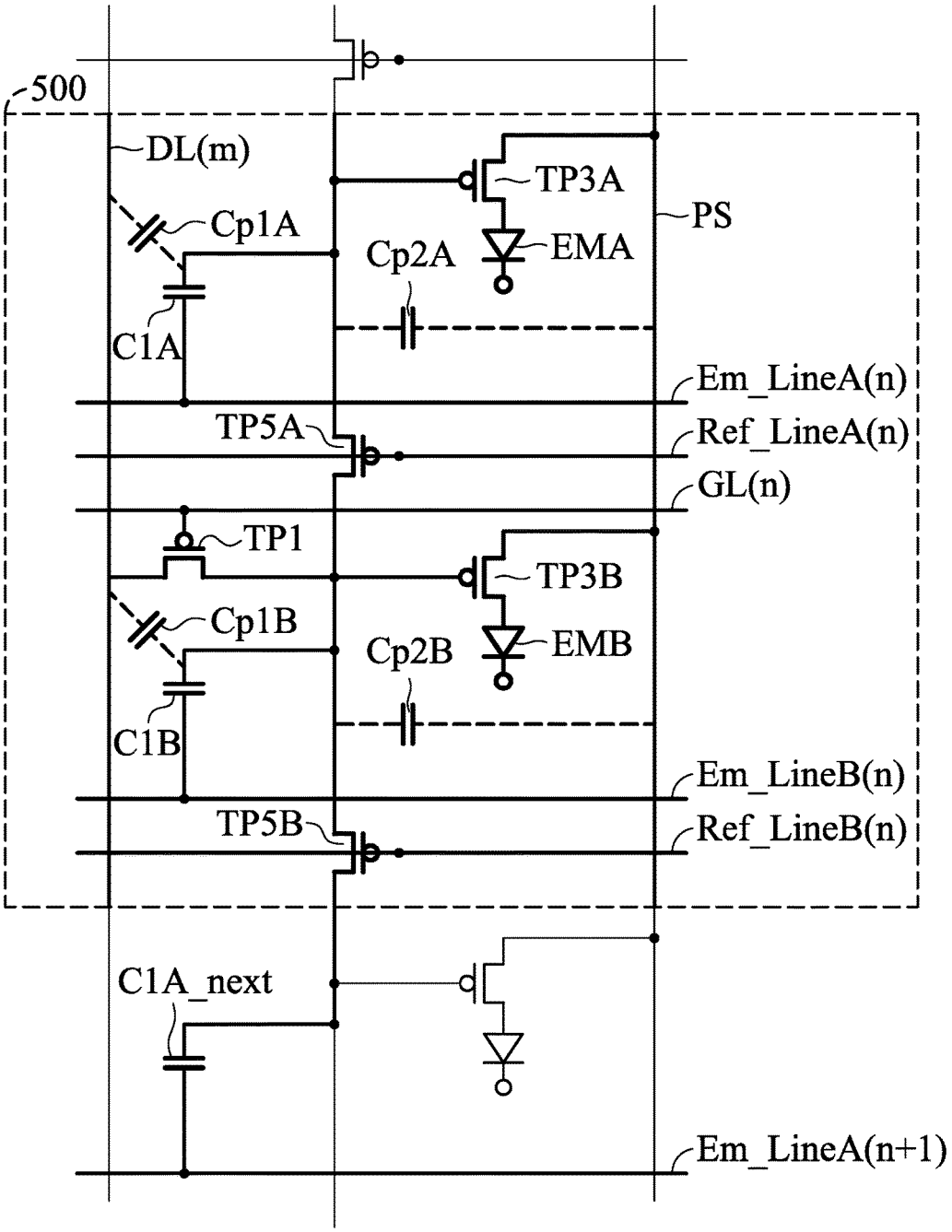
FIG. 5 is an exemplary circuit diagram of a pixel circuit according to a second embodiment of the invention.

FIG. 5 is an exemplary circuit diagram of a pixel circuit according to a second embodiment of the invention. In the second embodiment, the pixel array may comprise multiple pairs of pixel units. For example, a pair of pixel units is shown in FIG. 5. The pixel circuit 500 may comprise a first pixel unit and a second pixel unit. The first pixel unit may comprise a driving transistor TP3A, a reference transistor TP5A, a capacitor CIA, and an emissive element EMA. The second pixel unit may comprise a driving transistor TP3B, a reference transistor TP5B, a capacitor C1B, and an emissive element EMB. In the second embodiment, the selection transistor TP1 is shared by the two pixel units disposed adjacent to each other in the direction along the data line. In addition, the two pixel units further share the same gate line.

The driving transistor TP3A may comprise a control electrode coupled to the capacitor CIA, a first electrode coupled to the power source line PS, and a second electrode. The emissive element EMA, such as an OLED, may be coupled to the second electrode of the driving transistor TP3A and emit light according to a current drawn from the driving transistor TP3A. The driving transistor TP3B may comprise a control electrode coupled to the capacitor C1B, a first electrode coupled to the power source line PS and a second electrode. The emissive element EMB, such as an OLED, may be coupled to the second electrode of the driving transistor TP3B and emit light according to a current drawn from the driving transistor TP3B.

The selection transistor TP1 may comprise a control electrode coupled to the gate line GL(n) for receiving a selection signal, a first electrode coupled to the data line DL(m) and a second electrode coupled to the control electrode of the driving transistor TP3A (through the reference transistor TP5A) and the control electrode of the driving transistor TP3B. The reference transistor TP5A may comprise a control electrode coupled to a reference signal line Ref_LineA(n), a first electrode coupled to the control electrode of the driving transistor TP3A, and a second electrode coupled to the control electrode of the driving transistor TP3B. The reference transistor TP5B may comprise a control electrode coupled to another reference signal line Ref_LineB(n), a first electrode coupled to the control electrode of the driving transistor TP3B, and a second electrode coupled to the capacitor C1A_next of the next pixel circuit.

The capacitor CIA may comprise a first terminal coupled to the control electrode of the driving transistor TP3A and a second terminal coupled to an emission signal line Em_LineA(n). The capacitor C1B may comprise a first terminal coupled to the control electrode of the driving transistor TP3B and a second terminal coupled to an emission signal line Em_LineB(n).

There may be N*M such pixel circuits, as per the pixel circuit 500 shown in FIG. 5, arranged in a matrix in a display device to form a pixel array, where n, m, N and M are positive integers and $0 \le n \le N$, $0 \le m \le M$. Note that in an embodiment of the invention, one row (for example, the bottom row) of the pixel units in the pixel array may be designed as dummy pixel units.

Figure 6:
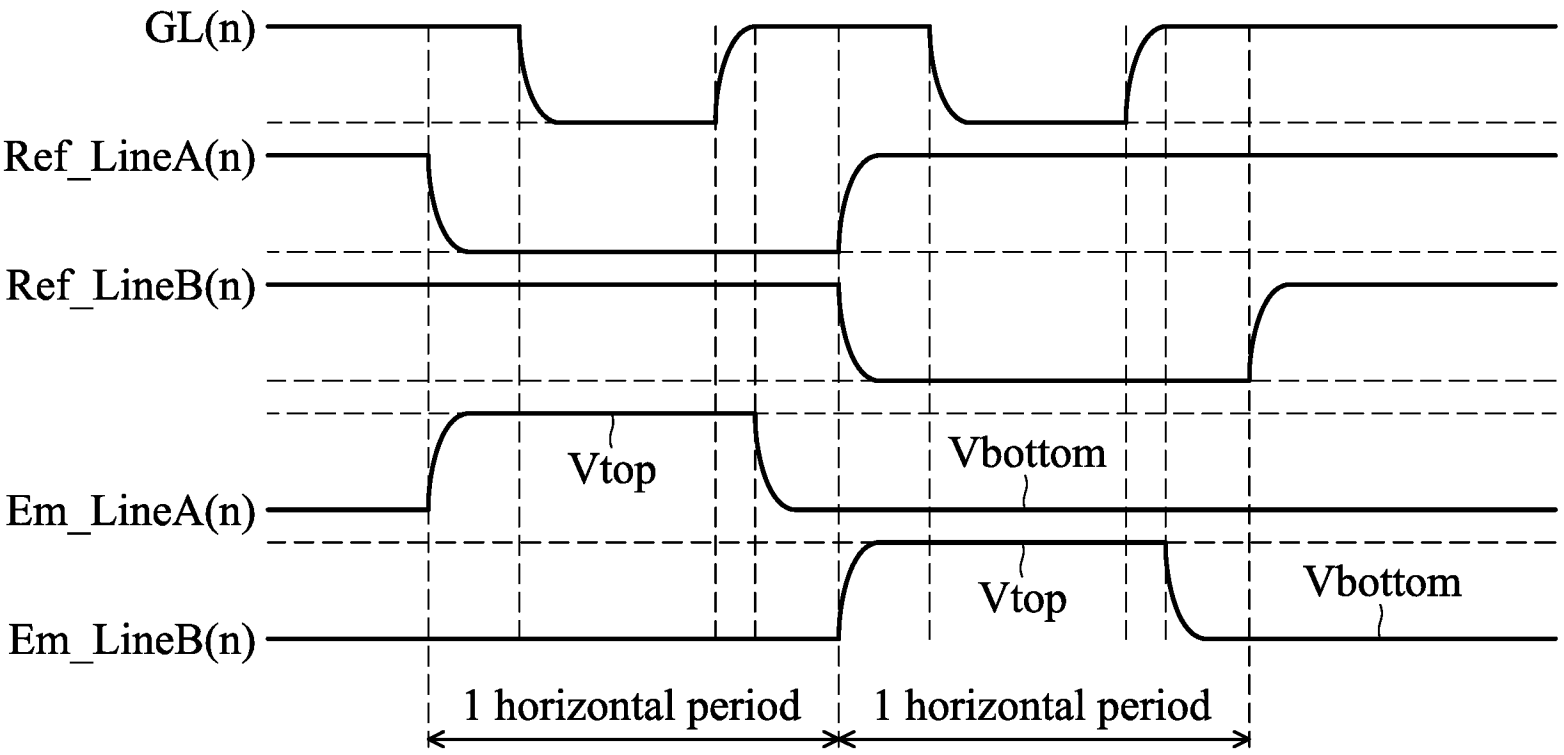
FIG. 6 is an exemplary diagram showing the signal waveforms for the pixel circuit with two pixel units sharing the same gate line according to an embodiment of the invention.

FIG. 6 is an exemplary diagram showing the signal waveforms for the pixel circuit with two pixel units sharing the same gate line, as shown in FIG. 5, according to an embodiment of the invention. According to an embodiment of the invention, since two pixel units share the same gate line, two consecutive selection signal pulses are applied on the gate line GL(n). The operations and the compensation mechanism of pixel circuit 500 are similar to those of pixel circuit 100.

As shown in FIG. 6, after the voltage at the reference signal line Ref_LineA(n) is set to the first predetermined level for the first horizontal period to turn on the reference transistor TP5A and voltage on the emission signal line Em_LineA(n) is set to the top voltage Vtop, a first selection signal pulse on the gate line GL(n) is applied (e.g. a falling edge of the first pulse on the gate line GL(n) as shown), to turn on the selection transistor TP1 (for the first time). When the selection transistor TP1 is turned on (for the first time), the data voltage Vdata is transmitted to capacitors CIA and C1B.

When the first selection signal pulse on the gate line GL(n) ends (e.g. after a rising edge of the first pulse on the gate line GL(n) as shown), the selection transistor TP1 is turned off (for the first time). After the selection transistor TP1 is turned off, the voltage on the emission signal line Em_LineA(n) is reduced from the top voltage Vtop to the bottom voltage Vbottom, to induce a voltage change or a voltage transition (that is, a voltage drop from a high level to a low level in this example) on the emission signal line Em_LineA(n). In response to the voltage change or voltage transition on the emission signal line Em_LineA(n), voltage at the control electrode of the driving transistor TP3A is changed as well with the Vth compensation effect as discussed above, and then the driving transistor TP3A is turned on to provide the current to the emissive element EMA. After that, the voltage at the reference signal line Ref_LineA (n) is reset to the second predetermined level.

Next, the voltage at the reference signal line Ref_LineB (n) is set to the first predetermined level for the second horizontal period. After the reference signal line Ref_LineB (n) is set to the first predetermined level to turn on the reference transistor TP5B and the voltage on the emission signal line Em_LineB(n) is set to the top voltage Vtop, a second selection signal pulse on the gate line GL(n) is applied (e.g. a falling edge of the second pulse on the gate line GL(n) as shown), to turn on the selection transistor TP1, again (for the second time). When the selection transistor TP1 is turned on (for the second time), the data voltage Vdata is transmitted to the capacitors C1B and the capacitor C1A_next of the next pixel circuit.

When the second selection signal pulse on the gate line GL(n) ends (e.g. after a rising edge of the second pulse on the gate line GL(n) as shown), the selection transistor TP1 is turned off (for the second time). After the selection transistor TP1 is turned off, the voltage on the emission signal line Em_LineB(n) is reduced from the top voltage Vtop to the bottom voltage Vbottom, to induce a voltage change or a voltage transition (that is, a voltage drop from a high level to a low level in this example) on the emission signal line Em_LineB(n).

In response to the voltage change or voltage transition on the emission signal line Em_LineB(n), the voltage at the control electrode of the driving transistor TP3B is changed as well with the Vth compensation effect as discussed above, and then the driving transistor TP3B is turned on to provide the current to the emissive element EMB. After that, the voltage at the reference signal line Ref_LineB(n) is reset to the second predetermined level.

Since the compensation mechanism of the pixel circuit 500 is similar to that of the pixel circuit 100, FIG. 3 can be referred to for detailed descriptions thereof, which are omitted here for brevity.

Note that, in the embodiments of the invention, when manufacturing the pixel array, the capacitance contributed by all the parasitic capacitors (such as parasitic capacitors Cp1A and Cp2A, and Cp1B and Cp2B as shown in FIG. 5) in each pixel unit is preferably controlled to be the same, such that the variation in the threshold voltage can be compensated for as discussed above.

In the first embodiment of the invention, the capacitor C1_next in the next pixel circuit is utilized during the operation of the pixel circuit 100 to provide capacitance when the reference transistor TP5 is turned on. Similarly, in the second embodiment of the invention, the capacitor C1B in the second pixel unit is utilized during the operation of the first pixel unit to provide capacitance when the reference transistor TP5A is turned on, and the capacitor C1A_next in the next pixel circuit is utilized during the operation of the second pixel unit to provide capacitance when the reference transistor TP5B is turned on.

Based on the operations described above, because the resulting voltage Vout at the control electrode of the driving transistor compensates for the threshold voltage variation by including the threshold voltage |Vth|, the current generated to drive the emissive element can be kept the same regardless of how much the threshold voltage Vth varies. The compensation mechanism works even when the amount of threshold voltage variation is different in different pixel circuits. In this manner, uniform current/luminance on a display can be obtained.

In addition, in the second embodiment of the invention, each pixel unit (except the dummy pixel unit) emits for a full frame period. Therefore, in the second embodiment of the invention, less driving current is drawn and a longer life span of the OLED material can be achieved compared to some sharing gate line designs. This is because in some sharing gate line designs, for example, one gate line is shared by two pixel units, so each pixel unit only emits for half a frame period, and thus the OLED in each pixel unit must emit 2 times the brightness for this half-frame period, resulting in 2 times the electrical current flow drawn for the half-frame period compared to the second embodiment of the invention. A greater current flow causes greater damage to the OLED material and shortens its life span. Therefore, compared to such designs, in the second embodiment of the invention, less driving current is drawn and a longer life span of the OLED material can be achieved.

Figure 7:
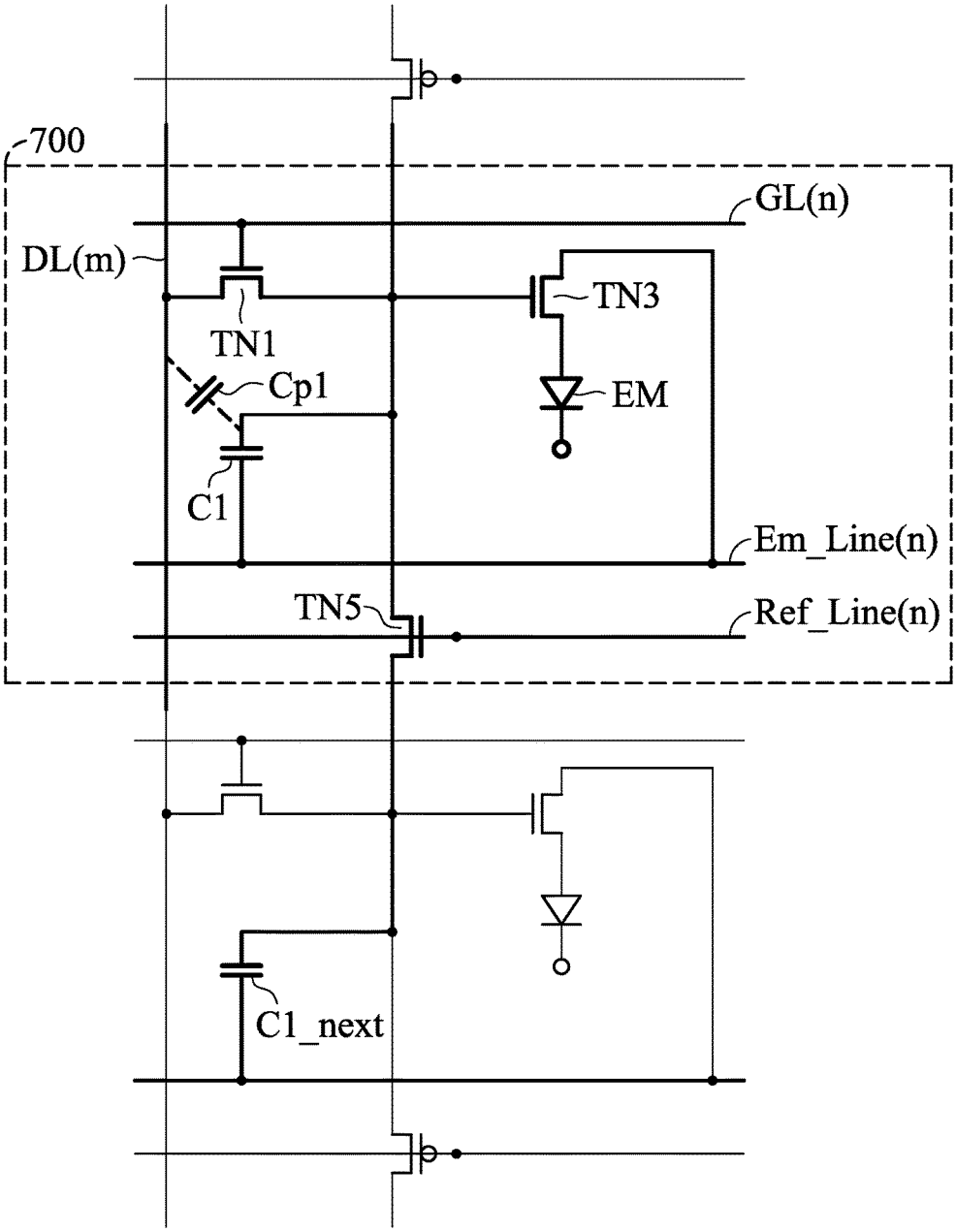
FIG. 7 is an exemplary circuit diagram of a pixel circuit according to a third embodiment of the invention.

FIG. 7 is an exemplary circuit diagram of a pixel circuit according to a third embodiment of the invention. In the third embodiment of the invention, the selection transistor TN1, the driving transistor TN3, and the reference transistor TN5 are N-type transistors and the power source line PS shown in FIG. 1 may be connected to or replaced by the emission signal line (therefore, represented by the emission signal line Em_Line(n)).

The selection transistor TN1 may comprise a control electrode coupled to a gate line GL(n) for receiving a selection signal therefrom, a first electrode coupled to a data line DL(m), and a second electrode. The driving transistor TN3 may comprise a control electrode coupled to the second electrode of the selection transistor TN1, a first electrode coupled to the emission signal line Em_Line(n), and a second electrode. The emissive element EM, such as an OLED, may be coupled to the second electrode of the driving transistor TN3 and emit light according to a current drawn from the driving transistor TN3. The capacitor C1 may comprise a first terminal coupled to the control electrode of the driving transistor TN3 and a second terminal coupled to the emission signal line Em_Line(n). The reference transistor TN5 may comprise a control electrode coupled to the reference signal line Ref_Line(n), a first electrode, and a second electrode. The first electrode of the reference transistor TN5 is coupled to the control electrode of the driving transistor TN3, and the second electrode of the reference transistor TN5 is coupled to the capacitor C1_next of the next pixel circuit. Note that the next pixel circuit comprises the same components and has the same structure as the pixel circuit 700. According to an embodiment of the invention, the reference signal line Ref_Line(n) may provide a selectable voltage with a first predetermined level and a second predetermined level.

There may be N*M such pixel circuits, as per the pixel circuit 700 shown in FIG. 7, arranged in a matrix in a display device to form a pixel array, where n, m, N and M are positive integers and $0 \le n \le N$, $0 \le m \le M$. Note that in an embodiment of the invention, one row (for example, the bottom row) of the pixel circuits in the pixel array may be designed as dummy pixel circuits.

Figure 8:
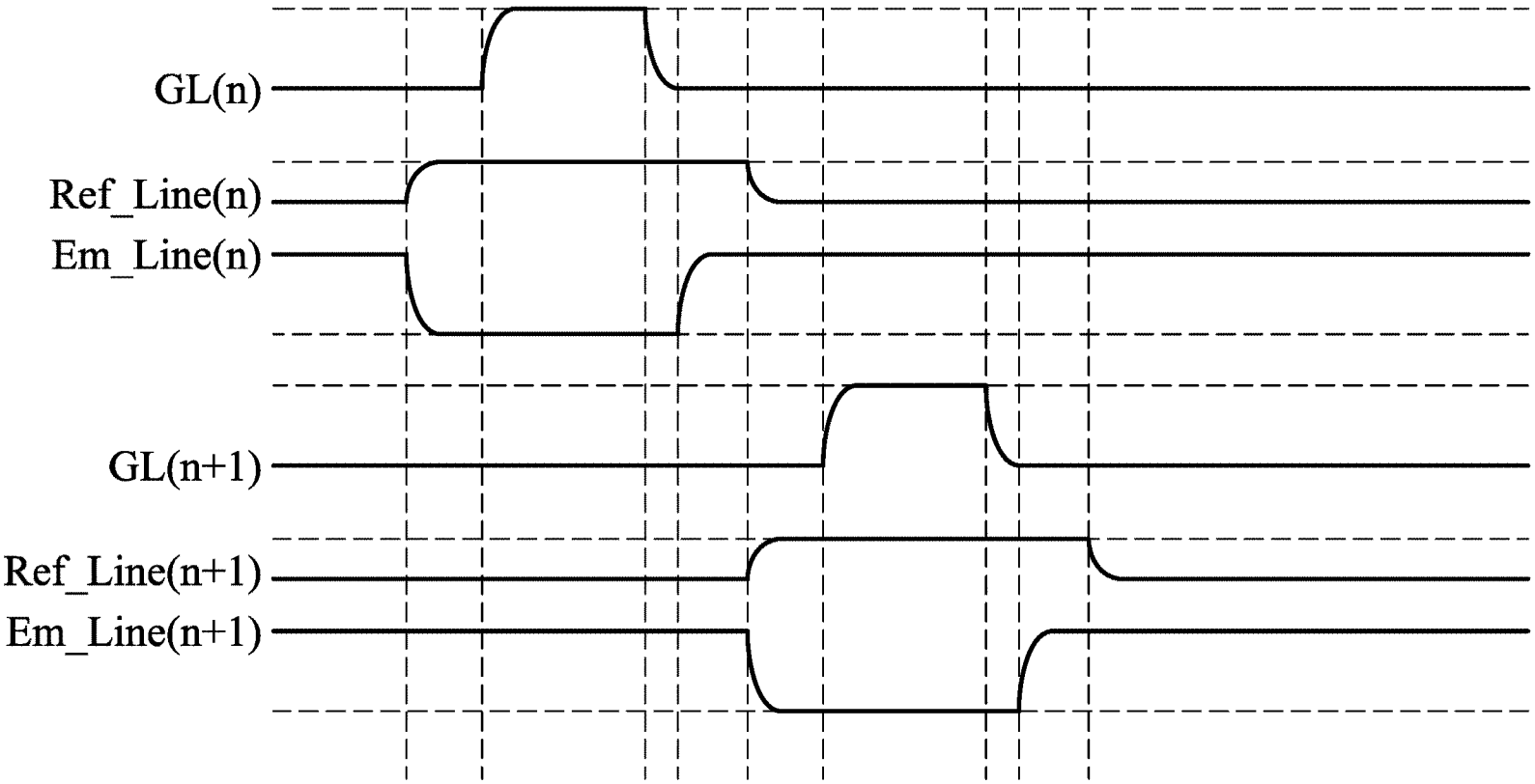
FIG. 8 is an exemplary diagram showing the signal waveforms according to an embodiment of the invention.

FIG. 8 is an exemplary diagram showing the signal waveforms according to an embodiment of the invention. As shown in FIG. 8, prior to the arrival of a selection signal pulse on the gate line GL(n), the voltage at the reference signal line Ref_Line(n) may be set from the second predetermined level (for example, 0V) to the first predetermined level (for example, +6V), which is higher than the second predetermined level. According to an embodiment of the invention, prior to the arrival of a selection signal pulse, the reference transistor TN5 is turned off when the voltage at the reference signal line Ref_Line(n) is set to the second predetermined level and turned on when the voltage at the reference signal line Ref_Line(n) is set to the first predetermined level. In addition, prior to the arrival of a selection signal pulse on the gate line GL(n), a falling pulse or a voltage may be generated on the emission signal line Em_Line(n) to set the voltage on the emission signal line Em_Line(n) to the bottom voltage Vbottom, and as the selection signal pulse ends, the voltage on the emission signal line Em_Line(n) is changed from a low level to a high level. In this embodiment, the selection signal pulse on the gate line GL(n) becomes an active high pulse to turn on the selection transistor TN1. The remaining operations of pixel circuit 700 are similar to those of pixel circuit 100, and the descriptions thereof are omitted here for brevity. In addition, the concept of the compensation mechanism of pixel circuit 700 is similar to that of pixel circuit 100, and FIG. 3 can be referred to for a detailed description thereof, which is omitted here for brevity.

Note that, based on the teaching of the structure shown in FIG. 7, N-type transistors can also be used in the embodiment of multiple pairs of pixel units with a shared selection transistor as shown in FIG. 5. Since those who are skilled in this technology can easily make such modifications without departing from the scope and spirit of this invention, the detailed descriptions are omitted here for brevity.

Figure 9A:
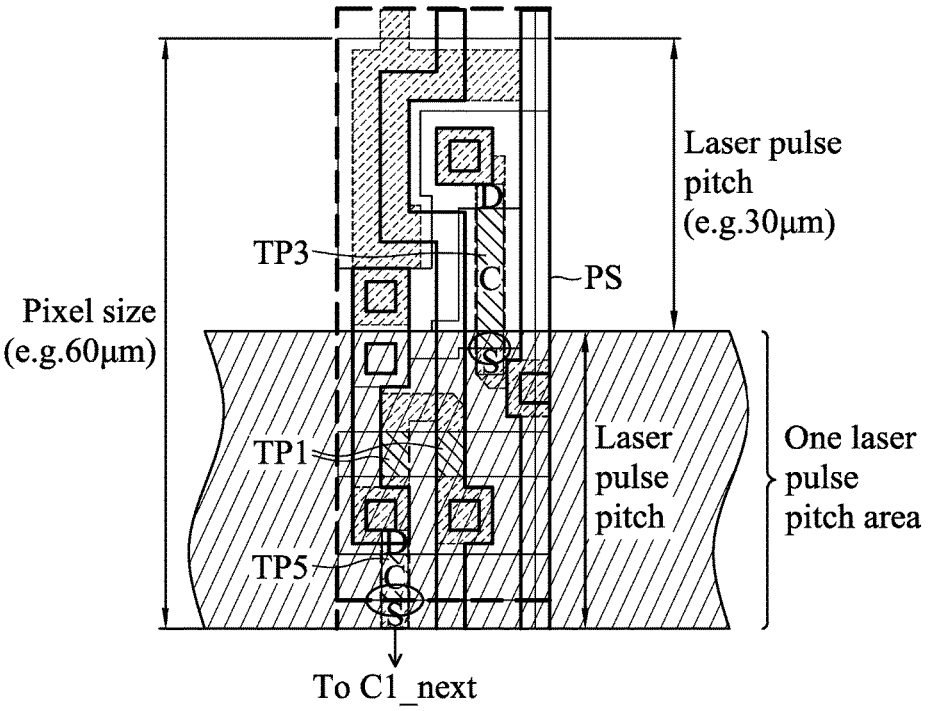
FIG. 9A is an exemplary diagram showing a sub-pixel layout according to an embodiment of the invention.
Figure 10:
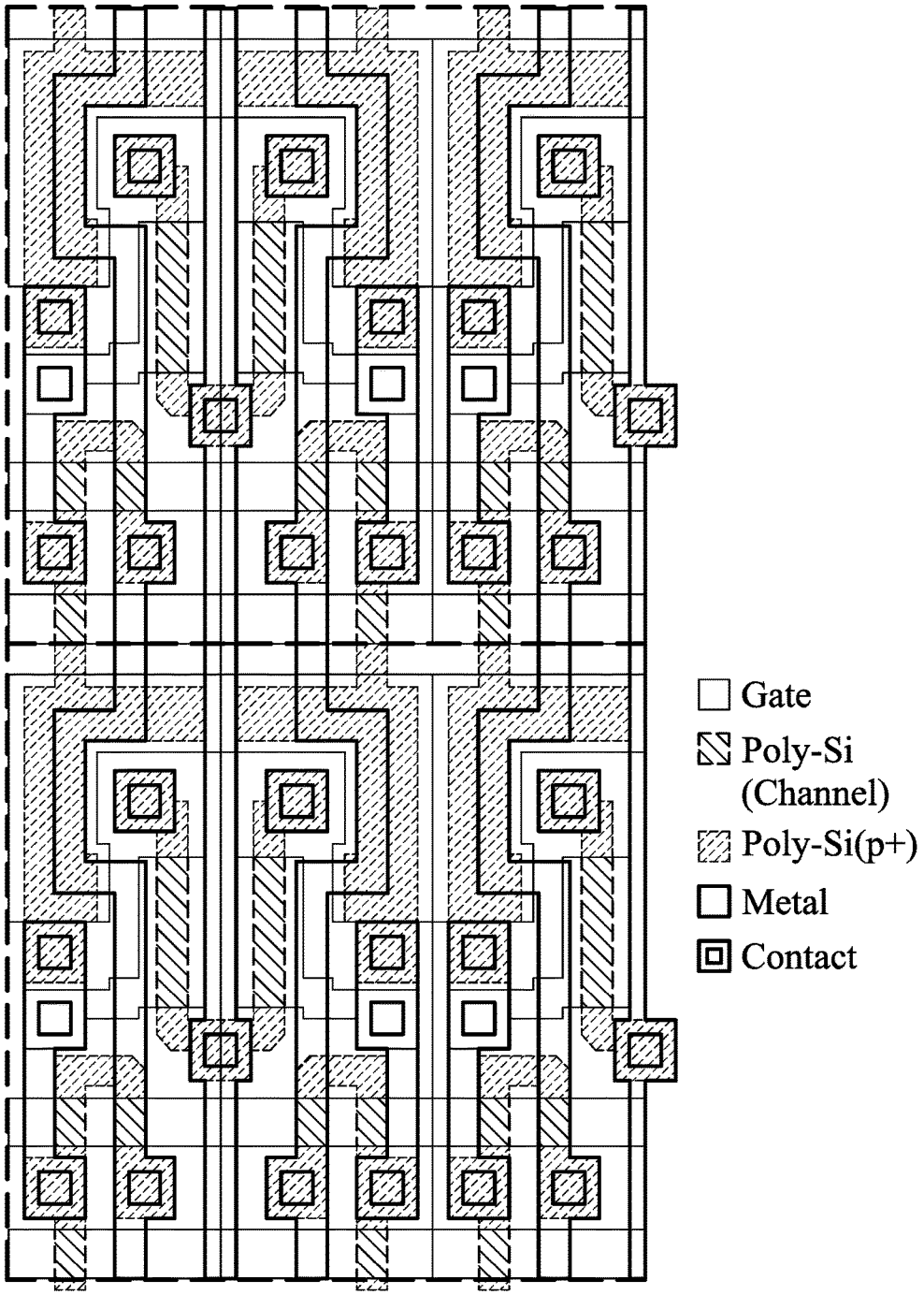
FIG. 10 is an exemplary diagram showing the layout of a pixel circuit according to an embodiment of the invention.

FIG. 9A is an exemplary diagram showing a sub-pixel layout according to an embodiment of the invention. FIG. 10 is an exemplary diagram showing the layout of a pixel circuit according to an embodiment of the invention. As discussed above, the embodiment of the invention premises the same Vth of the driving transistor TP3/TN3 and the reference transistor TP5/TN5. In this pixel layout, the portion in determining the Vth of the driving transistor TP3 and the reference transistor TP5, that is the "source-channel junction", is indicated by the circles shown in FIG. 9A.

Figure 9B:
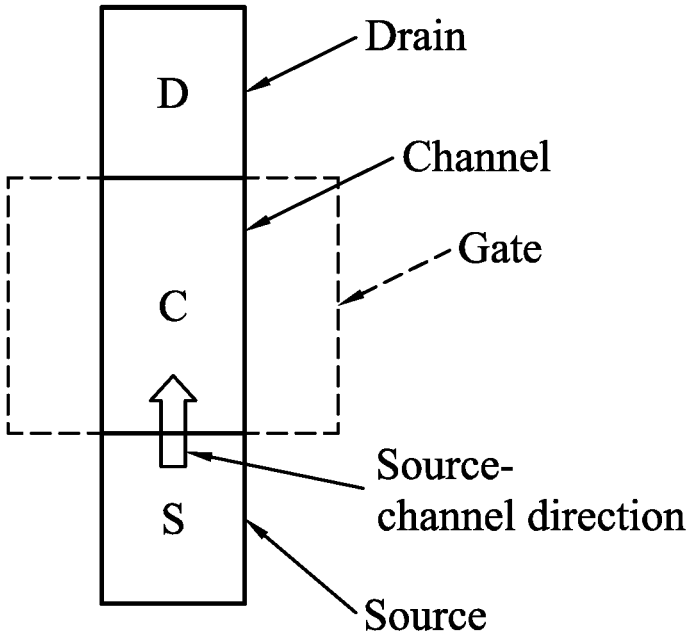
FIG. 9B is an exemplary diagram showing the exemplary source-channel direction according to an embodiment of the invention.

FIG. 9B is an enlarged chart further showing the exemplary source-channel direction according to an embodiment of the invention. For this pixel circuit using TFT fabricated with a laser annealing process and a laser lift off process, both the source-channel junctions of TP3 and TP5 in one pixel circuit should be disposed and aligned in the same direction in the same laser pulse pitch area as shown in FIG. 9A and FIG. 9B in order to suppress laser mura. Therefore, in one pixel circuit unit, the side of the electrode coupled to the power source PS of driving transistor TP3 (for example, the source electrode of the driving transistor TP3) (or, the side of the electrode coupled to the emissive element of driving transistor TN3) and the side of the electrode coupled to C1_next of the reference transistor TP5 (for example, the source electrode of the reference transistor TP5) (or, the side of the electrode coupled to C1_next of the reference transistor TN5) are disposed in the same laser pulse pitch area and aligned in the same source-channel direction.

Note that, in the laser annealing process, the laser pulse is emitted with a frequency, for example, of 300 Hz onto the glass substrate. In the poly-crystallization process, a laser shot is implemented multiple times, for example 20 times, in one place while moving on the substrate. Suppose that a laser pulse line beam shot is, for example, 300 mm(length)× 0.6 mm(width), 0.6 mm(width)/20=30 μm is the moving distance per 1 shot, and it is called the laser pulse pitch. The variation of energy strength of each laser pulse shot is large, so it causes TFT Vth characteristics to vary with laser pulse pitch (laser mura).

As discussed above, based on the pixel circuit structures given in the variety of embodiments of the invention, the threshold voltage variation can be compensated for by including the threshold voltage |Vth| of the reference transistor in the resulting voltage Vout at the control electrode of the driving transistor. In this manner, the non-uniform image problem caused by threshold voltage variations among different pixels in the conventional design can also be solved.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A pixel circuit, comprising:

a selection transistor, comprising a control electrode, a first electrode, and a second electrode, wherein the control electrode is coupled to a gate line for receiving a selection signal and the first electrode is coupled to a data line;

a driving transistor, comprising a control electrode, a first electrode, and a second electrode, wherein the control electrode is coupled to the second electrode of the selection transistor and the first electrode is coupled to a power source line;

an emissive element, coupled to the second electrode of the driving transistor and emitting light according to a current drawn from the driving transistor;

a first capacitor, comprising a first terminal coupled to the control electrode of the driving transistor and a second terminal coupled to an emission signal line; and a reference transistor, comprising a control electrode coupled to a reference signal line providing a selectable voltage with a first predetermined level and a second predetermined level, a first electrode, and a second electrode, wherein the first electrode of the reference transistor is coupled to the control electrode of the driving transistor, wherein the pixel circuit is comprised in a pixel array, and wherein the second electrode of the reference transistor is coupled to a second capacitor in another pixel circuit in the pixel array.

2. The pixel circuit as claimed in claim 1, wherein a data voltage on the data line is applied to the reference transistor when the selection transistor is turned on, and the data voltage is stored in the first capacitor and the second capacitor when the reference transistor is turned on.

3. The pixel circuit as claimed in claim 2, wherein when the selection transistor is turned off, a change in voltage is induced on the emission signal line, and the reference transistor is switched from being turned on to being turned off during the voltage change.

4. The pixel circuit as claimed in claim 3, wherein in response to the voltage change on the emission signal line, voltage at the control electrode of the driving transistor is changed and then the driving transistor is turned on to provide the current to the emissive element.

5. The pixel circuit as claimed in claim 3, wherein the driving transistor and the reference transistor are P-type transistors, and after the selection transistor is turned off, the voltage on the emission signal line is changed from a high level to a low level.

6. The pixel circuit as claimed in claim 3, wherein the driving transistor and the reference transistor are N-type transistors, and after the selection transistor is turned off, the voltage on the emission signal line is changed from a low level to a high level.

7. The pixel circuit as claimed in claim 1, wherein a source-channel junction of the driving transistor and a source-channel junction of the reference transistor are disposed in the same laser pulse pitch area and aligned in the same source-channel direction.

8. A pixel array, comprising:

a plurality of pixel circuits having the same structure, wherein each pixel circuit comprises:

a selection transistor, comprising a control electrode, a first electrode, and a second electrode, wherein the control electrode is coupled to a gate line for receiving a selection signal and the first electrode is coupled to a data line;

a driving transistor, comprising a control electrode, a first electrode, and a second electrode, wherein the control electrode is coupled to the second electrode of the selection transistor and the first electrode is coupled to a power source line;

an emissive element, coupled to the second electrode of the driving transistor and emitting light according to a current drawn from the driving transistor;

a first capacitor, comprising a first terminal coupled to the control electrode of the driving transistor and a second terminal coupled to an emission signal line; and a reference transistor, comprising a control electrode coupled to a reference signal line providing a selectable voltage with a first predetermined level and a second predetermined level, a first electrode, and a second electrode, wherein the first electrode of the reference transistor is coupled to the control electrode of the driving transistor, wherein the second electrode of the reference transistor of a first pixel circuit is coupled to the first capacitor of a second pixel circuit.

9. The pixel array as claimed in claim 8, wherein the first capacitor in the first pixel circuit and the first capacitor in the second pixel circuit have an equivalent capacitance.

10. The pixel array as claimed in claim 8, wherein a data voltage on the data line is applied to the reference transistor when the selection transistor of the first pixel circuit is turned on, and the data voltage is stored in the first capacitor of the first pixel circuit and the first capacitor of the second pixel circuit when the reference transistor of the first pixel circuit is turned on.

11. The pixel array as claimed in claim 8, wherein when the selection transistor of the first pixel circuit is turned off, a change in a voltage is induced on the emission signal line of the first pixel circuit, and the reference transistor of the first pixel circuit is switched from being turned on to being turned off during the voltage change.

12. The pixel array as claimed in claim 8, wherein in response to the voltage change on the emission signal line, a voltage at the control electrode of the driving transistor of the first pixel circuit is changed and then the driving transistor of the first pixel circuit is turned on to provide the current to the emissive element of the first pixel circuit.

13. The pixel array as claimed in claim 8, wherein a source-channel junction of the driving transistor and a source-channel junction of the reference transistor are disposed in the same laser pulse pitch area and aligned in the same source-channel direction.

14. A pixel circuit, comprising:

a pair of pixel units, comprising a first pixel unit and a second pixel unit, wherein the first pixel unit comprises:

a first driving transistor, comprising a control electrode, a first electrode coupled to a power source line, and a second electrode;

a first emissive element, coupled to the second electrode of the first driving transistor and emitting light according to a current drawn from the first driving transistor;

a first reference transistor, comprising a control electrode coupled to a first reference signal line, a first electrode coupled to the control electrode of the first driving transistor, and a second electrode; and a first capacitor, comprising a first terminal coupled to the control electrode of the first driving transistor and a second terminal coupled to a first emission signal line, and wherein the second pixel unit comprises:

a second driving transistor, comprising a control electrode, a first electrode coupled to the power source line, and a second electrode; and a second emissive element, coupled to the second electrode of the second driving transistor and emitting light according to a current drawn from the second driving transistor;

a second reference transistor, comprising a control electrode coupled to a second reference signal line, a first electrode coupled to the control electrode of the second driving transistor, and a second electrode; and a second capacitor, comprising a first terminal coupled to the control electrode of the second driving transistor and a second terminal coupled to a second emission signal line, and a selection transistor, comprising a control electrode coupled to a gate line for receiving a selection signal, a first electrode coupled to a data line and a second electrode coupled to the control electrode of the first driving transistor and the control electrode of the second driving transistor, wherein the second electrode of the first reference transistor is coupled to the first terminal of the second capacitor.

15. The pixel circuit as claimed in claim 14, wherein a data voltage on the data line is applied to the first reference transistor when the selection transistor is turned on for the first time, and the data voltage is stored in the first capacitor and the second capacitor when the first reference transistor is turned on.

16. The pixel circuit as claimed in claim 15, wherein when the selection transistor is turned off for the first time, a change in a voltage is induced on the first emission signal line, and the first reference transistor is switched from being turned on to being turned off during the voltage change.

17. The pixel circuit as claimed in claim 16, wherein in response to the voltage change on the first emission signal line, a voltage at the control electrode of the first driving transistor is changed and then the first driving transistor is turned on to provide the current to the first emissive element.

18. The pixel circuit as claimed in claim 14, wherein the pixel circuit is comprised in a pixel array, and wherein the second electrode of the second reference transistor is coupled to a third capacitor in another pixel circuit in the pixel array.

19. The pixel circuit as claimed in claim 18, wherein a data voltage on the data line is applied to the second reference transistor when the selection transistor is turned on for the second time, and the data voltage is stored in the second capacitor and the third capacitor when the second reference transistor is turned on.

20. The pixel circuit as claimed in claim 19, wherein when the selection transistor is turned off for the second time, a change in a voltage is induced on the second emission signal line, and the second reference transistor is switched from being turned on to being turned off during the voltage change.

21. The pixel circuit as claimed in claim 20, wherein in response to the voltage change on the second emission signal line, a voltage at the control electrode of the second driving transistor is changed and then the second driving transistor is turned on to provide the current to the second emissive element.

* * * * *